United States Patent [19]

Focke

[11] Patent Number: 5,056,294

[45] Date of Patent: Oct. 15, 1991

[54] APPARATUS (PACKAGING MACHINE) FOR THE PACKAGING OF ARTICLES OF DIFFERING SIZE

[75] Inventor: Heinz Focke, Verden, Fed. Rep. of Germany

[73] Assignee: Focke & Co., (GmbH & Co.), Verden, Fed. Rep. of Germany

[21] Appl. No.: 489,640

[22] Filed: Mar. 7, 1990

[30] Foreign Application Priority Data

Mar. 9, 1989 [DE] Fed. Rep. of Germany ..... 3907615

[51] Int. Cl.[5] ..... B65B 11/12

[52] U.S. Cl. ..... 53/201; 53/230

[58] Field of Search ..... 53/20, 228, 230, 231; 493/478, 479

[56] References Cited

U.S. PATENT DOCUMENTS

| | | | |
|---|---|---|---|
| 3,372,526 | 3/1968 | Anderson | 53/230 |
| 3,507,091 | 4/1970 | Mizelle | 53/230 X |
| 3,609,646 | 9/1952 | Total | 53/230 |
| 4,520,612 | 6/1985 | Muller | 53/201 |
| 4,569,180 | 2/1986 | Russo | 53/201 |
| 4,751,805 | 6/1988 | Walter | 53/201 X |

FOREIGN PATENT DOCUMENTS

| | | | |
|---|---|---|---|
| 0084442 | 7/1983 | European Pat. Off. . | |
| 1062619 | 7/1959 | Fed. Rep. of Germany . | |
| 2237948 | 5/1974 | Fed. Rep. of Germany . | |
| 2626459 | 12/1977 | Fed. Rep. of Germany | 53/201 |
| 3512462 | 12/1986 | Fed. Rep. of Germany . | |
| 111469 | 1/1965 | Netherlands . | |
| 327555 | 1/1958 | Switzerland . | |
| 426609 | 6/1967 | Switzerland . | |
| 565679 | 8/1975 | Switzerland . | |
| 244493 | 11/1926 | United Kingdom . | |
| 402052 | 2/1932 | United Kingdom | 53/201 |
| 911273 | 11/1962 | United Kingdom . | |

*Primary Examiner*—John Sipos

*Attorney, Agent, or Firm*—Sughrue, Mion, Zinn, Macpeak & Seas

[57] ABSTRACT

Apparatus (packaging machine) for the packaging of articles of differing sizes. In packaging technology, it is often necessary to solve the problem of producing packs of differing size on one and the same packaging machine. As a rule, adapting this to the different pack formats requires considerable conversion work. This in turn involves lengthy standstill phases of the packaging machine. To make it easier for the packaging to be changed over to different pack formats, packaging members, especially folding members, critical for the packaging process are provided in the form of a plurality of, preferably two sets (40, 41). A particular set of packaging members is in the packaging position (43). A further (part) set is an exchange position (44) for the exchange of individual or all packaging members for other formats. The format change is carried out in a simple way by bringing the set (40, 41) required for the particular size of the pack into the packaging position (43) as a result of a rotational or other movement. The standstill times of the packaging machine necessary for a format change are consequently minimal.

20 Claims, 10 Drawing Sheets

38
39
20
35

38
36
39
37
20
35

38
39
35
32

32
35

36
31
33
32

39
35
32
36
34
33

APPARATUS (PACKAGING MACHINE) FOR THE PACKAGING OF ARTICLES OF DIFFERING SIZE

BACKGROUND OF THE INVENTION

The invention relates to an apparatus (packaging machine) for the packaging of articles of differing size each into a blank of packaging material (large pack), especially for the packaging of a group of small packs (paper-handkerchief packs) into an outer blank of plastic film or the like (bundle), in a packaging station with packaging members, such as conveying members for the feed and provision of a blank, slides for transporting the small packs, folding members and, if appropriate, sealing members for the sealing of folding tabs.

The job of packaging articles of differing size alternately in one and the same apparatus (packaging machine) occurs frequently in packaging technology. Paper-handkerchief packs are conventionally on offer as large packs (bundles), a plurality of these small packs being combined by means of an outer wrapping to form the bundle. This can consist of six, eight, ten, twelve, eighteen or more small packs (paper-handkerchief packs).

The apparatus for producing these large packs is integrated in a production flow. Conventionally, a "packaging line" consists of a folding machine (for producing and stacking the paper handkerchiefs), a packaging machine for producing the paper-handkerchief packs, a bundle packer, a cartoning machine and so on and so forth.

The hitherto known packaging machines for the large packs (bundles) necessitate a considerable outlay in terms of labour when the production process is to be set to a different large-pack format. The changeover involves a lengthy standstill of the production line.

SUMMARY OF THE INVENTION

The object on which the invention is based is to design an apparatus for the production of packs of differing size (bundles), in such a way that a simple and quick changeover or adaptation to the processing of articles or packs of another size can take place.

To achieve this object, the apparatus according to the invention is characterized in that at least individual packaging members suitable for the format of the pack to be produced (large pack/bundle) are arranged so as to be exchangeable for those for the production of packs (large packs/bundles) of other dimensions.

According to the basic idea of the invention, the format-dependent members of the packaging machine are present in a plurality of versions (sets). Depending on the size of the pack (bundle) to be produced, the appropriate packaging members are installed by exchange. To make an easy exchange possible, the packaging members needing to be exchanged are arranged on mountings or carrier members allowing a quick exchange which can easily be carried out.

According to a further feature of the invention, the packaging machine is assigned at least two preferably complete sets of packaging members for different dimensions of the packs (bundles) to be produced, the sets being movable alternately into a packaging position. In the packaging position, the respective packaging members are in the particular position appropriate for the packaging operation. Moreover, movable packaging members are coupled in transmission terms to fixed-location drives of the packaging machine.

Alternatively, the packaging station of the apparatus can also be designed in such a way that two or more (complete) sets of packaging members for different packs are installed at a fixed location, and that the delivered articles (groups of small packs) to be packaged can be delivered alternately to one group of packaging members or another.

Where sets of packaging members to be exchanged for one another are concerned, these can be arranged on carriers or mountings which are displaceably mounted on rails, carrier rods or the like, the set of packaging members located in the working position being drawn off from the rails, rods or the like, and the set of packaging members suitable for the new format of the packs being pushed onto the rods, rails or the like.

In a further proposal of the invention, mountings and carriers for at least two (complete) sets of packaging members are arranged in the packaging station, one set of packaging members being moved into the packaging position, whilst a further set of packaging members is located in a standby position or exchange position.

In an especially advantageous version, a packaging machine is assigned two effective complete sets of packaging members. These are arranged offset approximately centrally relative to the longitudinal axis of a feed conveyor for the small packs and rotatably about a central rotary bearing with a vertical axis of rotation, in such a way that one particular set of packaging members is received in the packaging position and the other, offset at 180°, is received in an exchange position. In the packaging position, movable packaging members are coupled automatically to fixed-location drives.

The packaging members also include folding members for folding tabs in the outer wrapping of the bundle. On the one hand, this relates to a longitudinal fold made in a special way. To produce this, the set of packaging members is equipped with an upper folder and a lower folder.

Furthermore, side folds must be made. These consist of front and rear vertical side tabs as well as upper tabs and lower tabs. The first mentioned are brought into the folding position by side folders movable to and fro, the side folders being activated in a special novel way. The upper tabs and lower tabs are moved into the folding position in a way known per se via fixed-location folding switches, these being of special design for applying sealing heat and sealing pressure to the side fold.

An exemplary embodiment of the invention is explained in detail below by means of the drawings. In these:

DETAILED DESCRIPTION OF PREFERRED EMBODIMENTS

Figure 1:
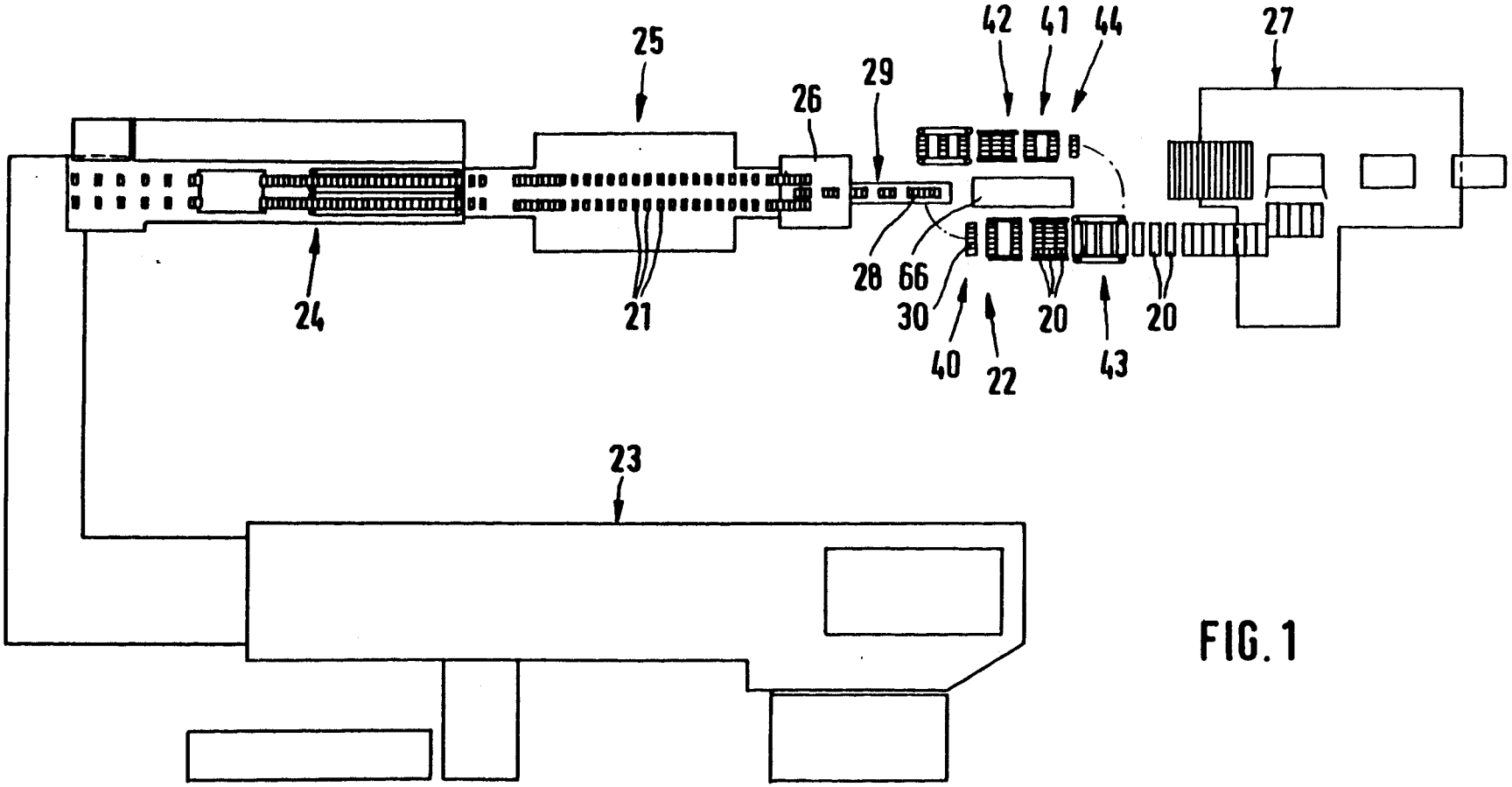
FIG. 1 shows a diagrammatic horizontal projection of an installation for the production and packaging of paper handkerchiefs ("line")

The exemplary embodiments illustrated in the drawings relate to the production of large packs, so-called bundles 20, consisting of a plurality of small packs 21, in this particular case paper-handkerchief packs. The bundles 20 are produced by a packaging machine suitable for these, namely a bundle packer 22. This is part of a manufacturing and packaging installation for paper handkerchiefs, namely a "line". It consists of a folding machine 23, a handkerchief-packaging machine 24, a following tape unit 25 for attaching a closing strip to the small pack 21, a stacking head 26, the following bundle packer 22 and a carton packer 27 following this.

In the present exemplary embodiment, the small packs 21 (handkerchief packs) are produced in two tracks. In the region of the stacking head 26, a common pack row 28 is formed, if appropriate from a plurality of small packs 21 arranged above one another. This is fed to the bundle packer 22 by a feed conveyor 29.

The large packs (bundles 20) can have different dimensions, depending on the number of small packs 21 per bundle 20. Small bundles 20 consist of six small packs 21, and large bundles 20 contain, for example, 24 small packs. These are formed into a uniform group 30 from small packs 21 aligned next to and above one another. The bundle 20 is formed by means of a wrapping 31 made of plastic film.

The bundle packer 22 is designed so that bundles 20 of differing size can be produced by exchange of packaging members. Packaging members are folding members for the wrapping 31, slides for transporting the groups 30, conveying members for film webs and sealing members. The number and type of packaging members depend on the design of the bundle 20 or the steps for the production of the wrapping 31.

In the present exemplary embodiment, the wrapping 31 is folded in a special way and results in a bundle 20 which is special in terms of the wrapping 31. The folding sequence is shown in FIG. 2 to FIG. 6.

Figures 2, 3, 4, 5, 6, 7:
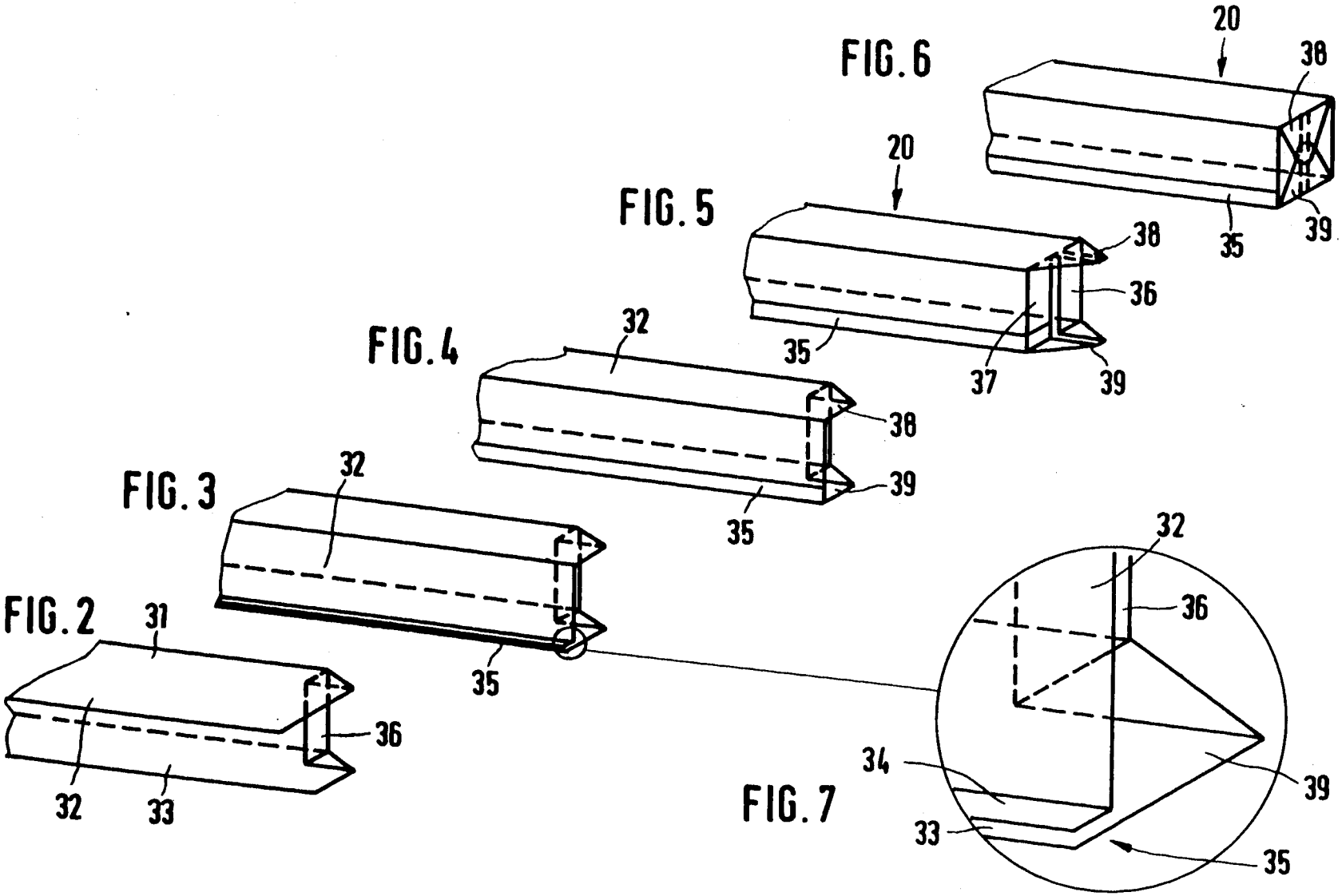
FIG. 2 to FIG. 6 show a perspective representation of different folding positions of the outer wrapping of a large pack (bundle)
FIG. 7 shows a corner design in the folding position according to FIG. 3 on a greatly enlarged scale.
Figure 8:
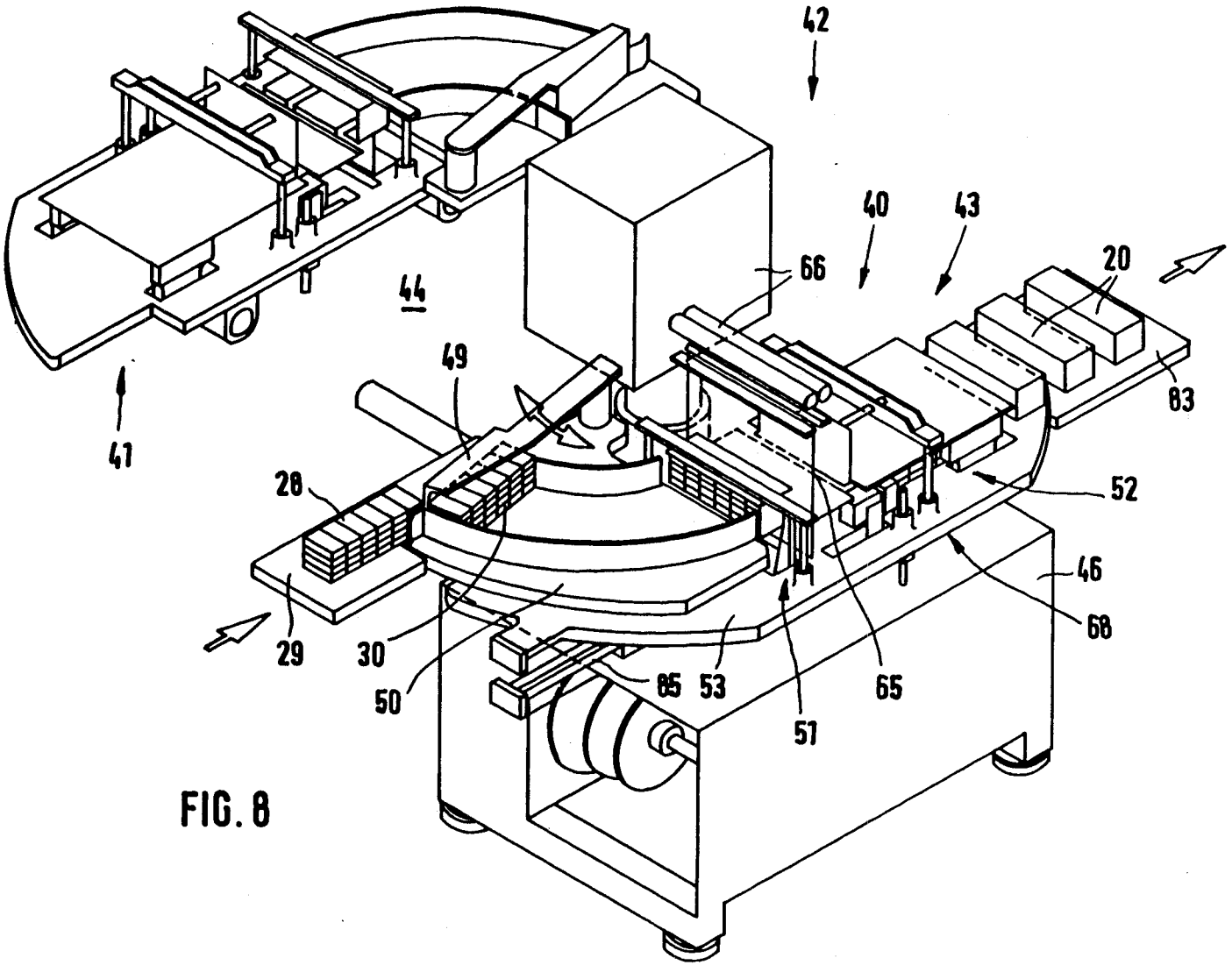
FIG. 8 shows a perspective view of an apparatus (packaging machine) for the production of large packs (bundles)
Figure 9:
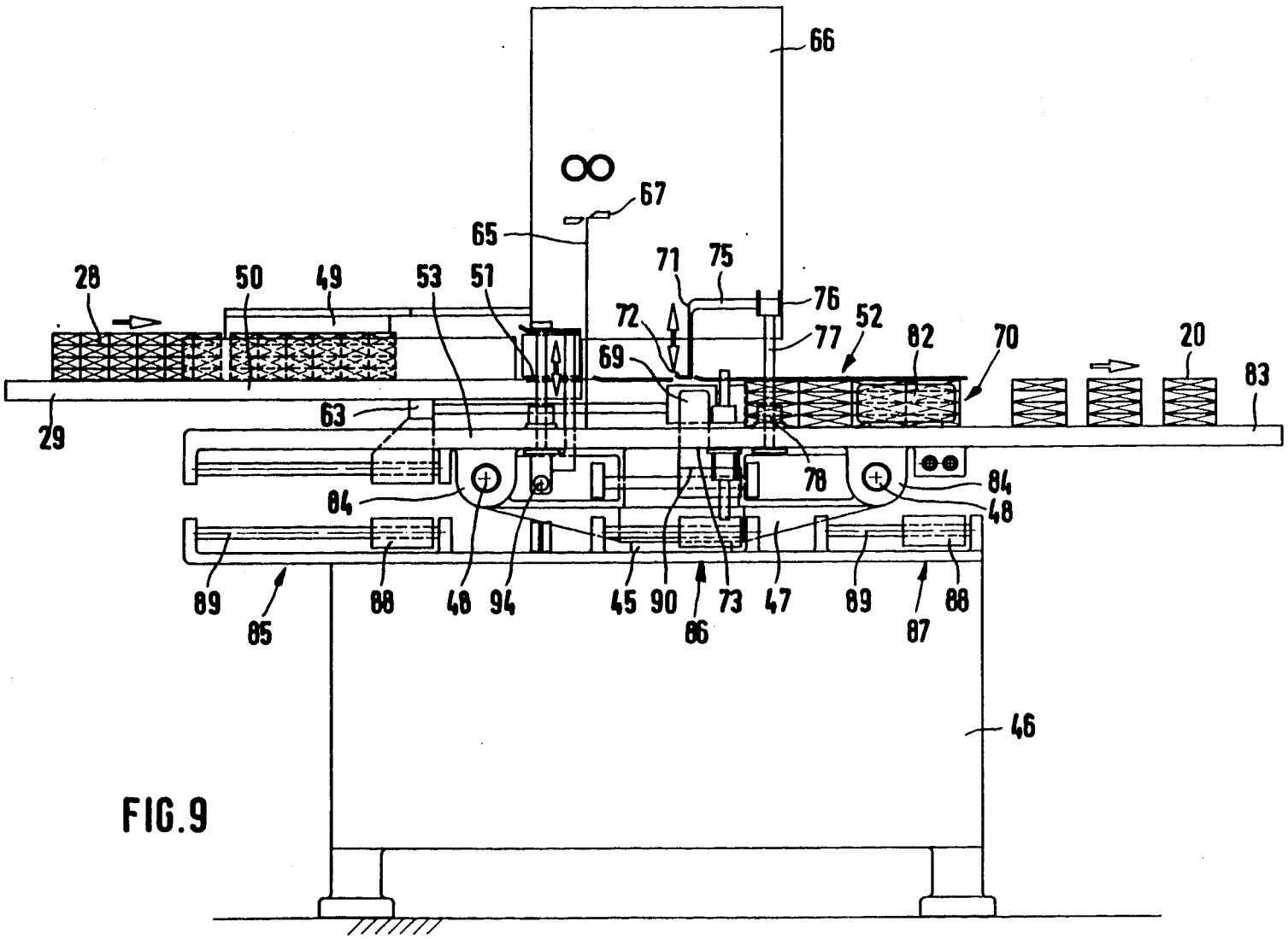
FIG. 9 shows a side view of the apparatus according to FIG. 8.
Figure 10:
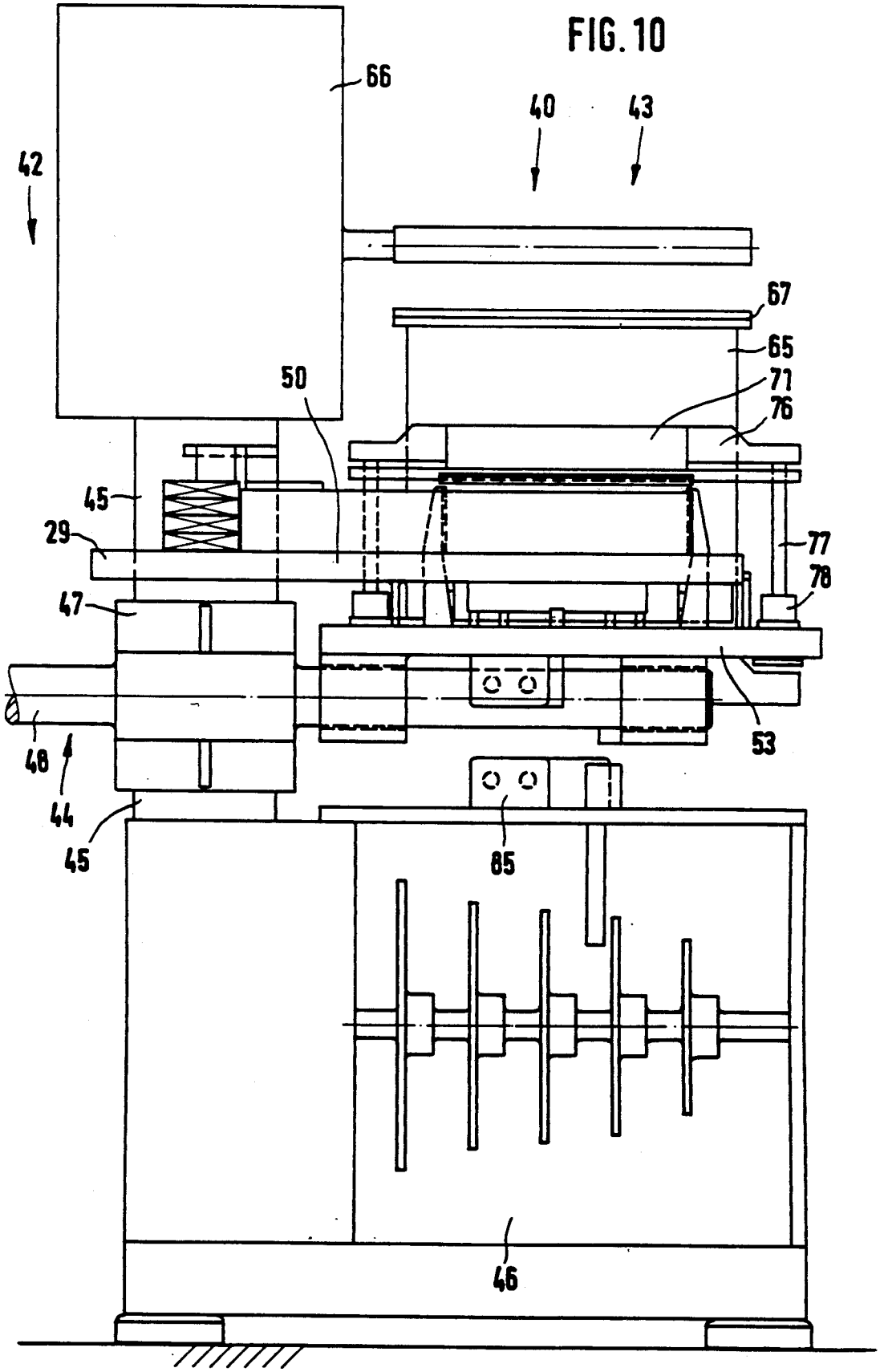
FIG. 10 shows a view of the apparatus according to FIGS. 8 and 9 offset at 90° relative to FIG. 9.

A blank for the wrapping 31 is provided in a vertical plane and folded in a U-shaped manner round the content (group 30), specifically as a result of the conveyance of the group 30 through the plane of the blank. Horizontally directed longitudinal tabs 32, 33 initially thereby projecting on the rear side of the group 30 have different lengths. The dimensions of the upper longitudinal tab 32 are such that the rearward-pointing longitudinal side of the bundle 20 or of the group 30 is covered over its full height. This longitudinal tab 32 is folded into the vertical position up against the rear side of the group 30 (FIG. 3). During this folding operation, a lower edge tab 34 of the longitudinal tab 32 is laid onto the top side of the lower longitudinal tab 33 of corresponding size and is sealed together with this by means of heat and pressure (FIG. 3 and the detail in FIG. 7). A two-ply edge strip 35 thereby formed is then folded into a vertical position up against the side face or against the upper longitudinal tab 32 (folding position according to FIG. 4).

Folding tabs (initially) project beyond the group 30 in the region of side faces of the bundle 20. Front side tabs 36 and rear side tabs 37 are folded successively against the side face of the group 30. During the transport of the group 30 together with the wrapping 31, the front side tab 36 is folded (FIG. 2). Only later, in particular after the completion of the rear wall of the wrapping 31, is the rear side tab 37 folded as a result of an appropriate movement of a folding member (FIG. 5). Then, (triangular) upper tabs 38 and lower tabs 39 are folded round against the side faces or the side tabs 36, 37 (FIG. 6). The upper tabs 38 and lower tabs 39 on the one hand and the side tabs 36 and 37 on the other hand are sealed together with one another by means of heat and pressure.

The means necessary for this folding and sealing operation together form a complete set of packaging members. The bundle packer 22 is assigned several sets of packaging members, these appropriately being exchangeable complete for adaptation to different formats of the bundles 20.

The bundle packer 22 illustrated and described here is designed for receiving two sets 40, 41 of packaging members. These sets 40 and 41 are located in the packaging station 42. At any time, one of the sets, the set 40 in the example shown in FIG. 1, is in the packaging position 43. The small packs 21 or the groups 30 are fed to this.

In the present exemplary embodiment, the sets 40 and 41 are connected removably to an adjustable carrier device, in particular a swivel mechanism which moves the sets 40, 41 either into the packaging position 43 or into an exchange position 44 as a result of a rotational movement. In the region of the last-mentioned position, the packaging members of the set 41 are exchanged preferably complete as a unit.

This swivel mechanism consists, here, of a vertical carrier column 45 which is connected firmly to a machine stand or to a drive housing 46. A crossmember 47 is mounted rotatably on the carrier column 45. Mountings for the sets 40, 41, in particular transversely directed carrier rods 48, are attached to the ends of the crossmember 47. The packaging members of the sets 40, 41 are attached so that they can be removed, in particular drawn off, onto these horizontally directed carrier rods rotatable together with crossmember 47 about the carrier column 45.

The pack row 28 is fed to the packaging station 42 approximately centrally relative to the latter. In the present case, the feed conveyor 29 is aligned centrally with a carrier column 45. A number of small packs 21 corresponding to the size of the bundle, arranged severally above one another, is grasped by a transversely movable pivoting slide 49 acting along a quarter circle and is conveyed along a quarter circle on a plate-shaped upper track 50 into the packaging position 43. The pivoting slide 49 is connected to a plate forming the upper track 50.

At the end of the upper track 50, the group 30 of small packs 21 comes into the region of a lifting stage 51, the most important function of which is to lower the group from the plane of the upper track 50 to the level of a main track 52. This consists of a track plate 53 offset in terms of height relative to the upper track 50. The packaging members are arranged or are effective on the main track 52.

The lifting stage 51 consists of a platform 54, on which the group 30 is pushed by the pivoting slide 49. The platform 54 is formed by three part platforms which are supported on a lower transversely directed carrier section 55. The top side of the lifting stage 51 is formed by a platform cover 56 which rests on the top side of the group 30. The platform cover 56 is connected to an upper transverse rod 57. This and the lower carrier section 55 are connected to one another by means of vertical guide rods 58. The guide rods 58 are movable up and down in fixed plain bearings 59 on the track plate 53.

A further special feature of the lifting stage 51 is that its side walls 60 are transversely movable in order to exert a lateral pressure on the small packs 21 of the group 30. It is thereby possible to set the group 30 as the content of the bundle 20 to exact and always recurring dimensions. For this purpose, the side walls 60 are mounted pivotally on pivoting arms 61 which are connected to the lower carrier section 55 via a pivot bearing 62. For receiving a group 30, the side walls 60 are moved apart from one another. The side walls 60 are thereafter moved towards one another, thereby compressing the small packs 21.

Figure 12:
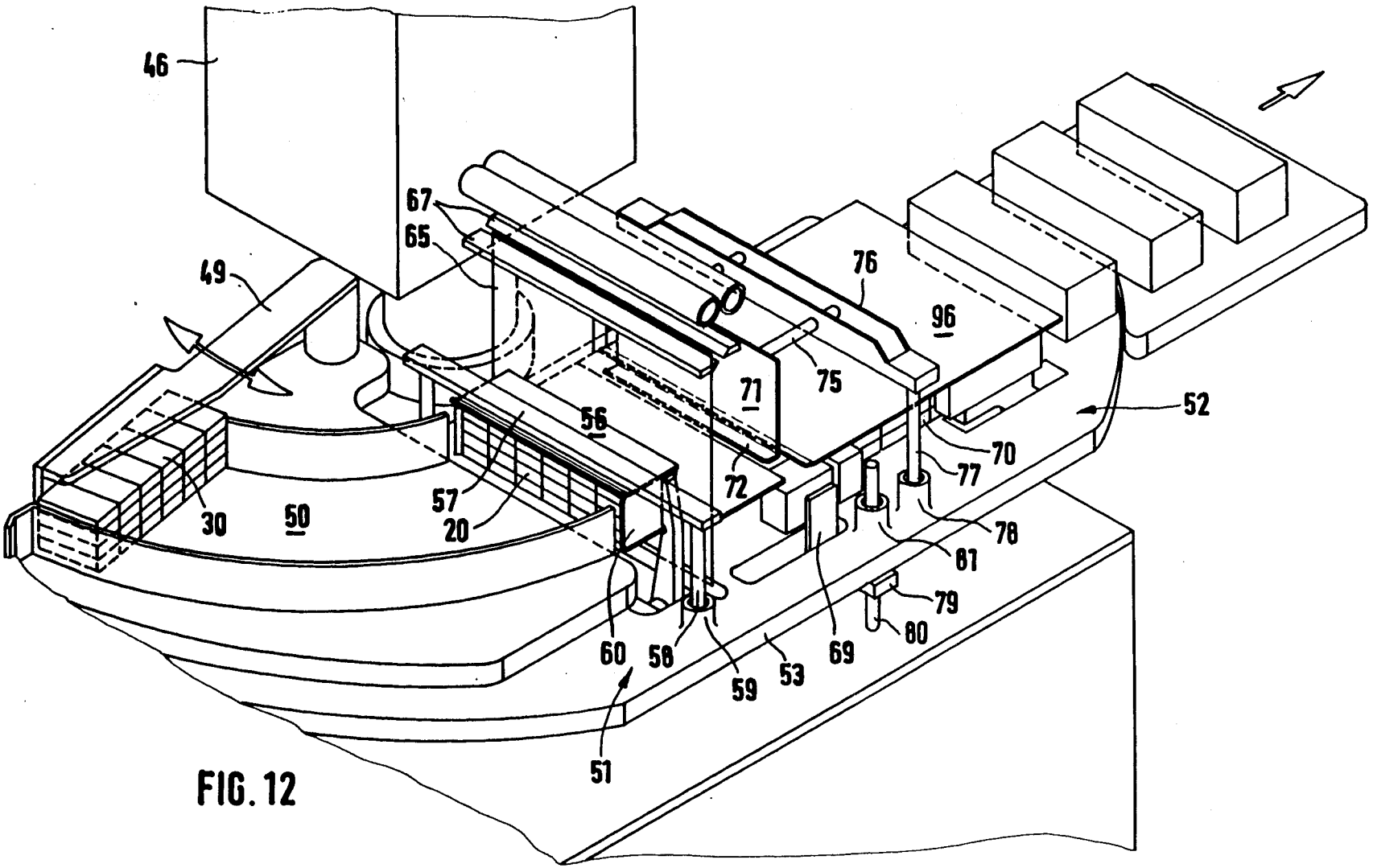
FIG. 12 shows details of the apparatus in a representation corresponding to that of FIG. 8 and on an enlarged scale.
Figure 13:
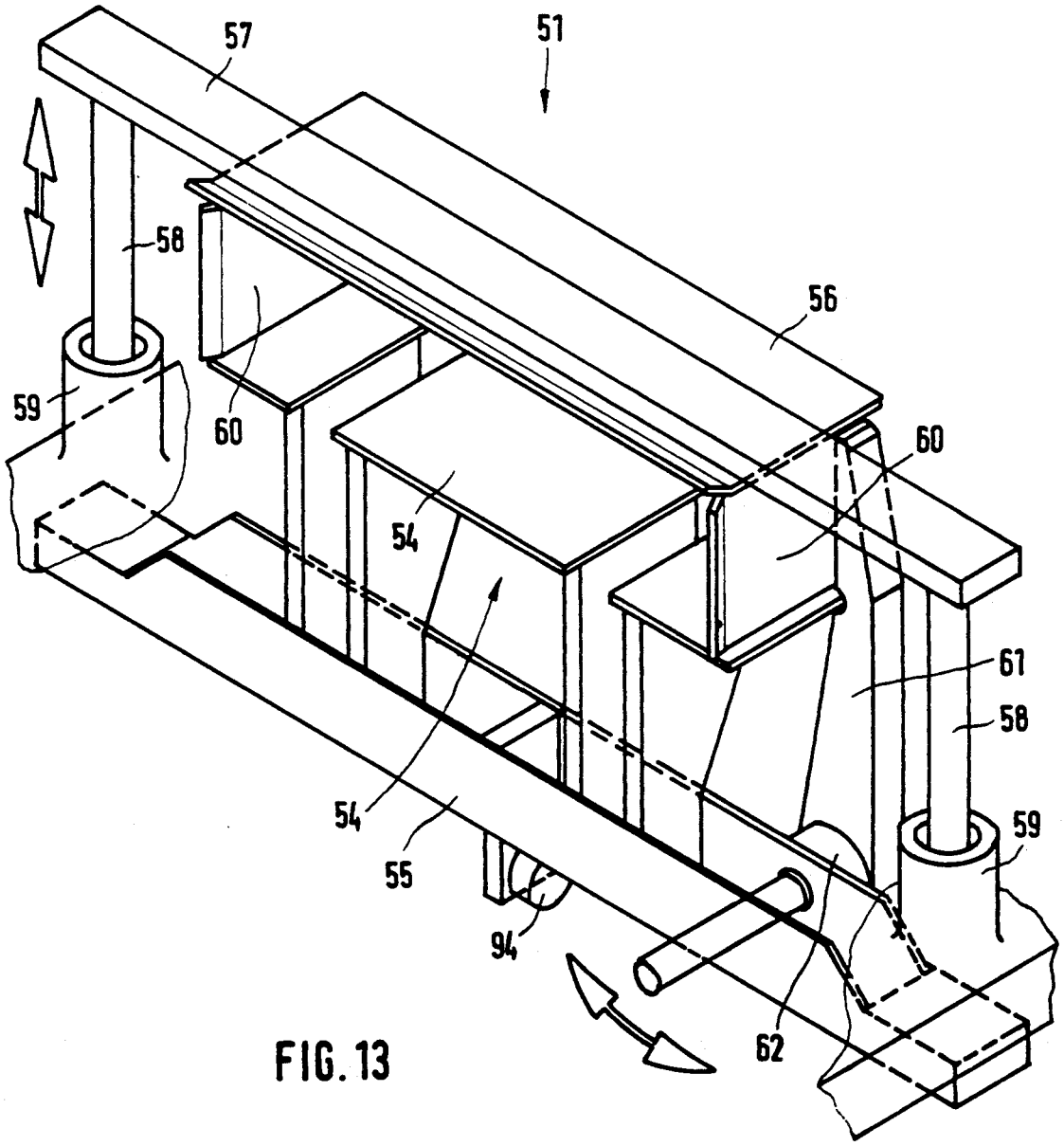
FIG. 13 shows a detail of the apparatus, namely a lifting stage, in a perspective representation and enlarged.

In the upper initial position (FIG. 12), the lifting stage 51 together with the platform 54 is aligned with the upper track 50. After the group 30 has been received, the lifting stage 51 is lowered until the platform 54 is aligned with the main track 52.

When the stage 51 is in this lower position, the group 30 is ejected, specifically by a pushing-off device 63. This passes through the lifting stage 51, at the same time taking up the group 30. The pushing-off device 63 guided by slide rods 64 located underneath the track plate 53, whilst the pushing-off device 63 itself moves above the latter.

The group 30, when it leaves the lifting stage 51, passes through the plane of a film web 65. This is provided in a vertical plane by a film appliance 66. The film web 65 is taken up by the group 30, a measured blank for forming the wrapping 31 being severed from the film web 65 by severing knives 67. The blank is laid round the group 30 in a U-shaped manner and is then folded in the way described above (FIGS. 2 to 6).

This folding takes place in the region of a folding station 68. During the conveying movement of the group 30 together with the wrapping 31, the side tabs 36 located at the front in the direction of movement are folded by side folders 69 on both sides of the path of movement of the group 30. For this purpose, the side folders are moved out of a forward position towards the group 30 and into the region of the side tabs 36. These are folded by the side folders 69, the side folders 69 subsequently being conveyed further together with the group 30.

The group 30 together with the wrapping 31 (and with the side folders 69 located in the folding position) is conveyed up against a bundle row 70 of already substantially ready-folded bundles 20, the bundle row 70 at the same time being moved further by the amount of a movement stroke corresponding to the dimensions of the bundle 20. The pushing-off device 63 then returns to the initial position.

Meanwhile, the side folders 69 on both sides of the bundles 20 are moved further in the opposite direction to the movement of the bundles 20, the side folders 69 coming out of the region of the group 30 on the not yet folded rear side of the wrapping 31 (the position according to FIG. 2).

The folding of the longitudinal tabs 32, 33 to form the edge strip 35 can now take place (folding operations according to FIGS. 3 and 4). For the downward folding of the upper longitudinal tab 32, there is an upper folder 71, which consists here of a relatively thin wall with a lower angled leg 72. This presses the edge tabs 32 onto the lower projecting longitudinal tabs 33.

Figure 14:
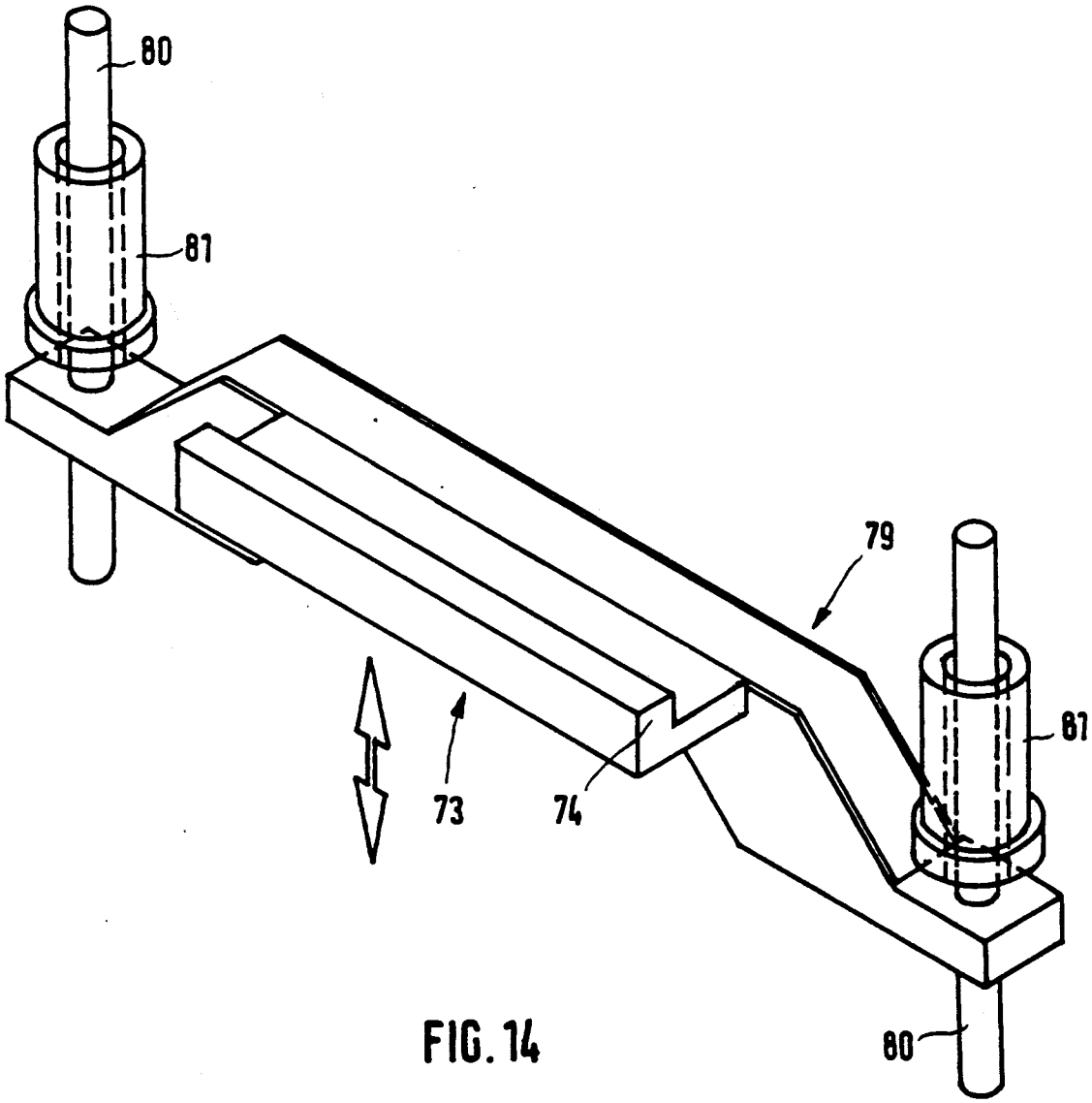
FIG. 14 shows a further detail, namely a folding and sealing tool, likewise in a perspective representation and enlarged.

The longitudinal tab 33 rests on a lower folder 73 which serves at the same time as a sealing tool and which is therefore heatable. The lower folder 73 is designed as an angular section piece (FIG. 14). In the initial position, the approximately horizontally directed edge strip 35 rests on an upwardly directed leg 74 of the lower folder 73. After the edge tab 34 has been joined to the longitudinal tab 33, as a result of an upward movement of the lower folder 73 the edge strip 35 is pressed against the rear longitudinal face of the wrapping 31 or against the longitudinal tabs 32 and sealed together with this.

The upper folder 71 and lower folder 73 are merely movable up and down. The upper folder 71 is connected via retaining rods 75 to a carrier section 76 extending transversely above the folding station 68. This carrier section 76 is supported on the track plate 53 movably via lateral vertical guide rods 77. The guide rods 77 are movable up and down in sliding guides 78 in the track plate 53 in order to execute the folding movement.

In the initial position, the lower folder is mounted underneath the track plate 53 or the main track 50 in such a way that the leg 74 is flush with the underside of the bundle 20. The lower folder 73 is attached laterally to a sectional rod 79 which is itself connected at the ends to guide rods 80. These in turn are mounted in a vertical arrangement slideably in sliding guides 81 on or in the track plate 53. The lower folder 73, in keeping with its function, executes only small lifting movements.

After the foregoing folding operations have been carried out, the next group 30 together with a wrapping 31 is supplied, the side folders 69 running together with this following group 30 in the way described, thereby folding round the side tabs 36. The relative position of the side folders 69 is such that, in the end position, a region of the side folders 69 located at the front in the direction of movement comes into the region of the side faces of the bundle 20 located in front of it in the bundle row 70. The side tab 37 at the rear in the conveying direction is at the same time folded round (FIG. 5).

During the further transport of the bundle row 70, the upper tab 38 and lower tab 39 are folded by fixed immovable folding members of a type known per se, in particular by so-called folding switches (not shown). These are designed as fixed walls which are arranged laterally next to the path of movement of the bundles 20 and which, as a result of a curved design of a folding edge, fold the upper tab 38 and lower tab 39 in succession during the movement of the bundles 20.

When the folded form according to FIG. 6 is obtained, the side face is sealed, in particular the overlapping regions of the upper tab 38 and lower tab 39 are sealed with one another, by means of a plate-shaped sealing tool 82. The bundle 20 is thus completed. It can now be transported away in a suitable manner via a fixed discharge-conveyor track 83.

The side folders 69 are mounted in a similar way to the upper folder 71 and lower folder 73. A carrier section 90 extends transversely underneath the track plate 53. Attached to the ends of the carrier section 90 are vertical angle sections which respectively receive the cuboid side folders 69. The carrier section 90 is driven to and fro underneath the track plate 53 in the direction of movement of the bundles 20.

The above-described folding, conveying and sealing members form a (complete) set 40, 41 of packaging members. The sets 40, 41 can be modified in terms of the type and number of packaging members for other types of packs.

In the present exemplary embodiment, the packaging members to be exchanged for a change of format of the packs (bundles 20) to be produced are arranged on a common carrier, in particular on the track plate 53. Also connected to this is the plate-shaped upper track 50 with the members, especially the pivoting slide 49, attached to it.

The common carrier (track plate 53) is mounted easily removably on holding members in the packaging station 42. These are the horizontally directed carrier rods 48 which are connected to the crossmember 47 and on which the track plate 53, together with bearing pieces 84 arranged on the underside of this, is mounted so that it can be shifted and consequently drawn off. To exchange a complete set 40, 41, the track plate 53 is drawn down from the carrier rods 48 in the region of the exchange station 44 and exchanged for another set.

During the exchange or during the movement of a set 40, 41 into the packaging position 43, the movable packaging members of a set 40, 41 are coupled automatically to non-exchangeable drives of fixed location. In the present example, drive members 85, 86, 87 for different movable packaging members are arranged on the top side of the machine stand or of the drive housing 46. In the present case, these drive members 85, 86, 87 consist of drive pieces 88 which are slideably displaceable on (two) fixed sliding rods 89. The drive pieces 88 are driven by gears, for example cam discs, inside the drive housing 46.

Figure 11:
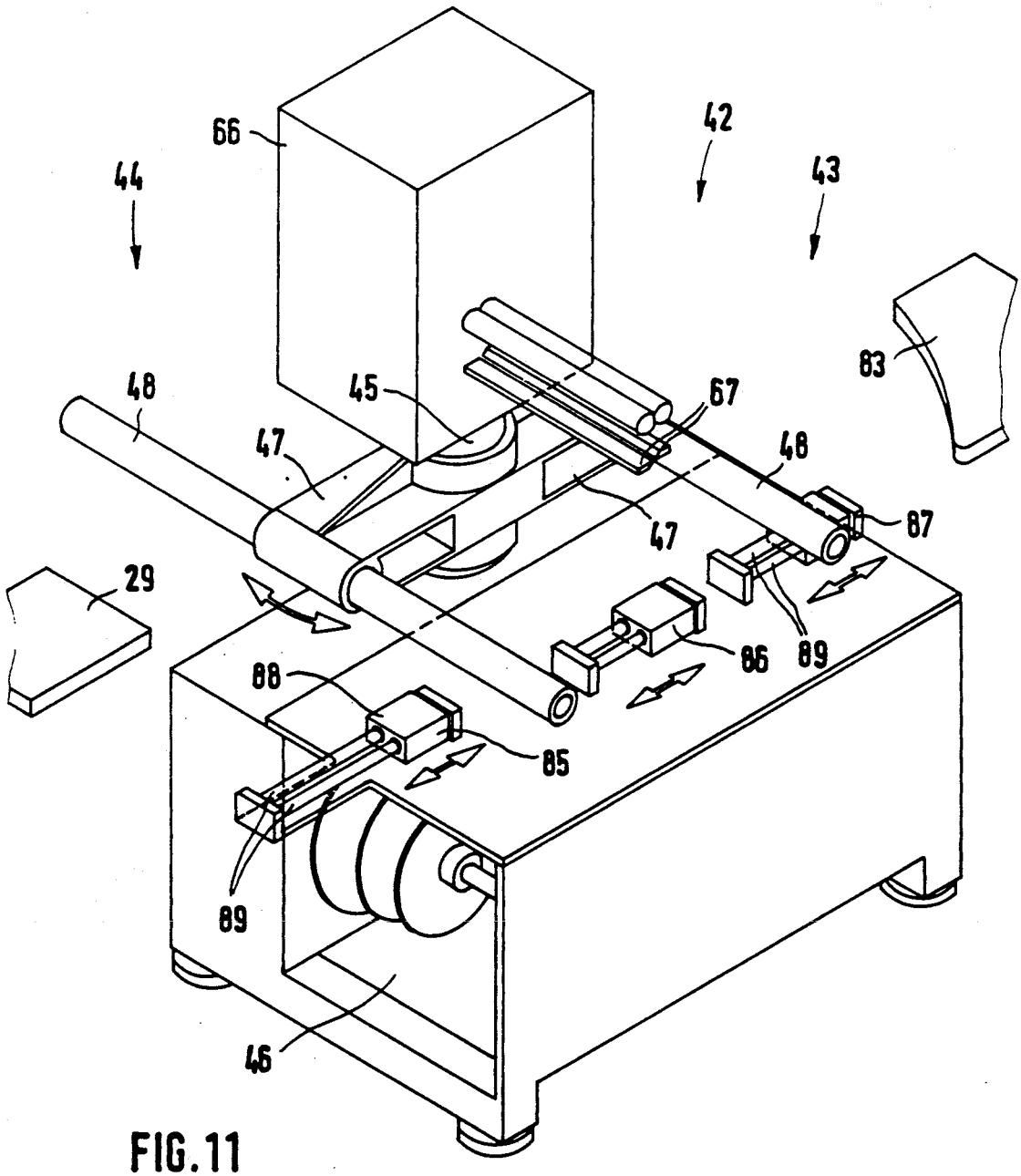
FIG. 11 shows a perspective representation of the apparatus according to FIGS. 8 to 10, with parts removed.
Figure 15:
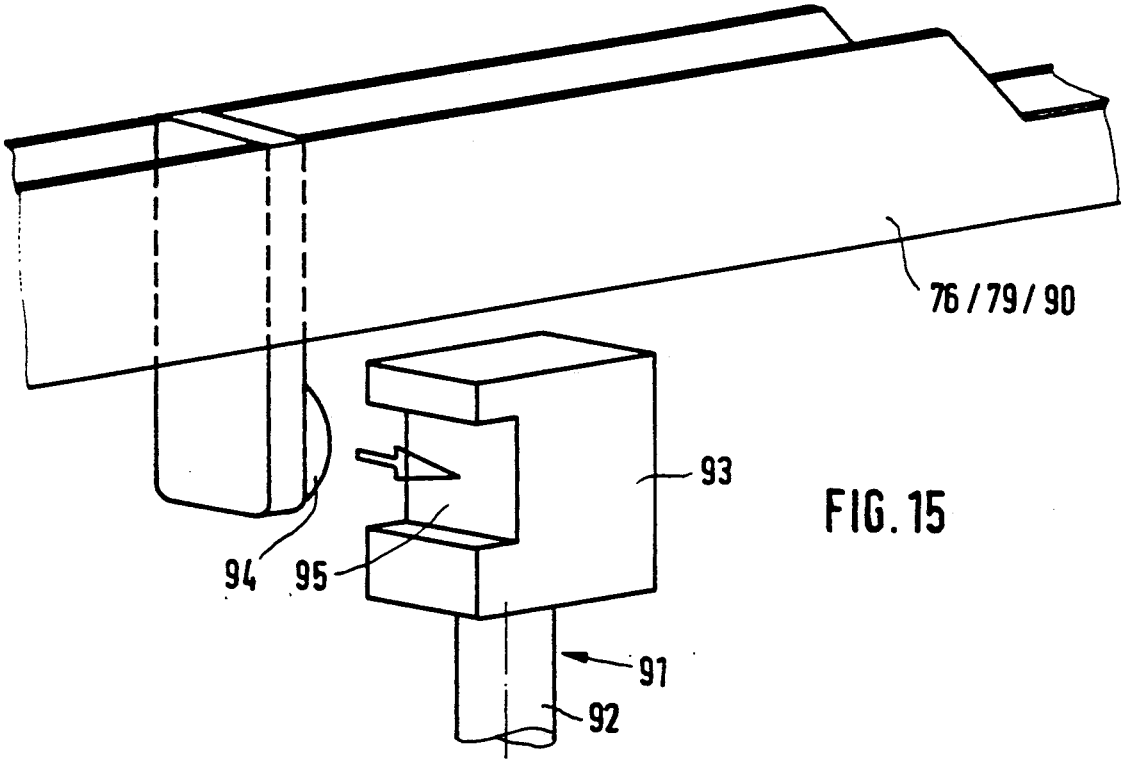
FIG. 15 shows a perspective representation of a couplable drive connection for parts of the apparatus.
Figure 16:
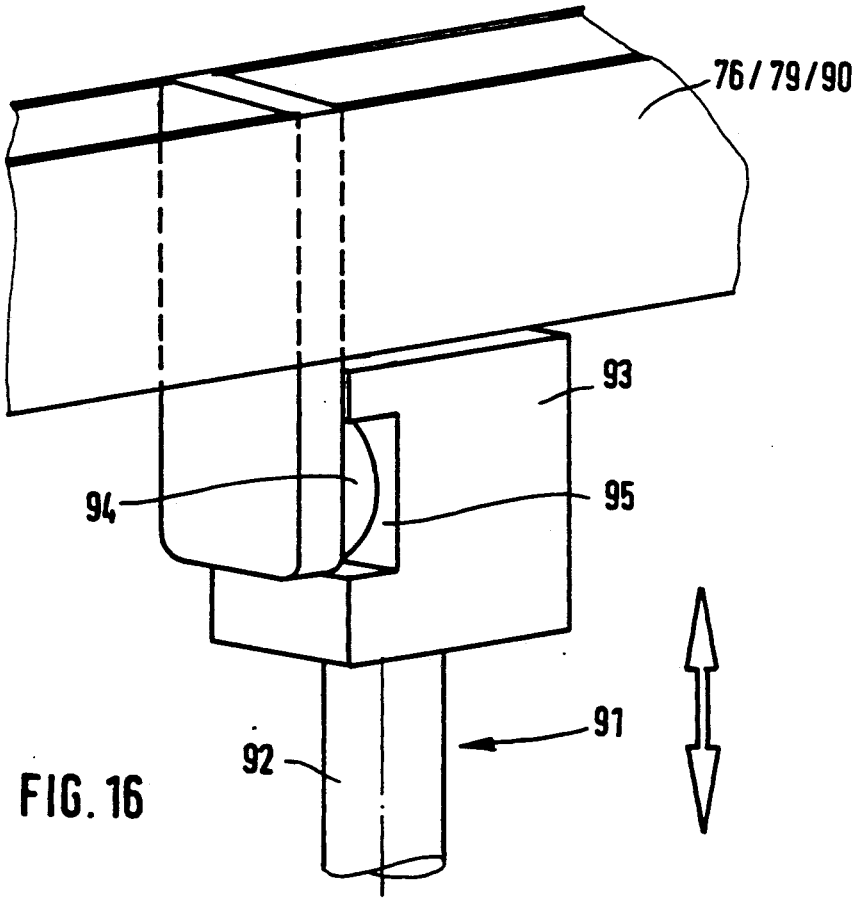
FIG. 16 shows the details according to FIG. 15 in the coupled position.

The drive members shown here by way of example in FIG. 11 are assigned to the pushing-off device 63 (drive member 85), to the side folders 69 (drive member 86) and to the sealing tools 82 (drive member 87). Furthermore, there are lifting members 91 which are likewise mounted on or on top of the drive housing 46 and are movable up and down (FIGS. 15, 16). A lifting member 91 of this type is assigned to the upper folder 71 and to the lower folder 73. In the exemplary embodiment illustrated, a lifting rod 92 is equipped at the upper end with a coupling head 93. This, as a result of the movement of a set 40, 41 into and out of the packaging position 43, is coupled automatically to the packaging member to be actuated. For this purpose, in the exemplary embodiment shown here, a rotatable coupling roller 94 is attached to the packaging member. This coupling roller 94 engages into a slot guide 95 laterally on the coupling head 93. As is evident from FIG. 16, in the working position of the packaging members this makes a positive connection for the transmission of drive movements. The couplings for the drive members 85, 86 and 87 are also designed in a similar way.

The transport of the bundles 20 or groups 30 after they leave the lifting stage 51 takes place via an upper guide in the form of a track cover 96. This extends from the region of movement to the lifting stage 51 as far as the completion position of the bundles 20 at a distance from the track plate 53 corresponding to the exact dimensions of the bundles 20. Orifices are provided in the track cover 96 for the passage of folding members, etc.

In the present exemplary embodiment, the film appliance 66 with severing knife 57 and conveying rollers is connected firmly to the carrier column 45, therefore always remaining in the packaging position 43. Alternatively, the film appliance 66 can be arranged exchangeably or be rotatable together with the movable sets 40, 41. It is thereby possible to provide two different versions of the film appliance. The film appliance can also be changed at the same time as the set 40, 41 is changed.

Moreover, alternative versions for the mounting and exchangeability of the sets 40, 41 are possible.

What is claimed:

1. An apparatus for packaging a group of small packs into one appropriately sized outer wrapping (31) of plastic film for making a larger bundle (20), said apparatus comprising:

a) a packaging station (42) comprising:
- a feed conveyor (29) for longitudinally feeding a group of small packs (21);
- a main track (52) on which the small packs (21) and the bundle (20) rest and are transported;
- first conveying means for feeding a film web (65) transverse to a longitudinal direction of movement of the small packs (21);
- severing knives (67) for severing a blank from the web (65);
- second conveying means (63) for conveying the small packs in a region of said packaging station (42);
- first folding means, in the form of an upper folder (71) and a lower folder (73), for folding the blank in a region of a rear side of the bundle (20) to be made; and
- second folding means, in the form of side folders (69), for folding front and rear side tabs (36, 37) which laterally project from the group of small packs (21);

b) a first carrier device (53);

c) first exchangeable packaging means, coupled to said first carrier device (53) and dependent on the size of bundles (20) to be made, comprising at least said main track (52), a pushing-off device (63), said upper folder (71), said lower folder (73) and said side folders (69);

d) mounting means for rotatably mounting said first carrier device for rotation about an axis of rotation (45), which is arranged offset next to said packaging station (42), from a packaging position within the packaging station (42) to an exchange position (44) laterally offset thereto and next to the packaging station (42); and e) opposite the carrier device (53) relative to said axis of rotation (45), a corresponding second carrier device which is rotatable, together with said first carrier device (53), about said axis of rotation from said exchange position (44) into said packaging station (42), said second carrier device carrying second exchangeable packaging means for packaging a bundle (20) having a format different from that accommodated by said first exchangeable packaging means.

2. Apparatus according to claim 1, further comprising mounting means for mounting each of said first and second packaging means such that the packaging means in said exchange position is completely or partially removable from said mounting means.

3. Apparatus according to claim 1, further comprising carrier rods (48) on which each of said first and second packaging means is mounted and also removable therefrom by being drawn off.

4. Apparatus according to claim 3, further comprising a cross-member (47) on ends of which said carrier rods (48) are rotatably mounted, said cross-member (47) being rotatably mounted in a central rotary bearing (45) in such a way that said first and second packaging means are movable into a packaging position (43) and into said exchange position (44), respectively, as a result of rotation along a path of movement of 180°.

5. Apparatus according to claim 1, wherein said packaging position (43) is arranged offset relative to the longitudinal direction of said feed conveyor (29) for the small packs (21), and wherein groups (30) of small packs (21) are divided off from a pack row (28) transversely relative to said feed conveyor (29) and are fed to a packaging means along a path of a quarter circle.

6. Apparatus according to claim 1, wherein each of said packaging means is movable by fixed-location drive means, in the form of drive members (85, 86, 87) and lifting member (91), and is automatically couplable to said drive means as a result of rotation of a packaging means into said packaging position.

7. Apparatus according to claim 6, further comprising positive coupling means for connecting said drive means to each of said packaging means.

8. Apparatus according to claim 7, wherein said positive coupling means comprises a coupling head (93) having a slot guide (95) into which a coupling element (94) of each packaging means penetrates as a result of rotational movement thereof.

9. Apparatus according to claim 1, wherein said feed conveyor (29) feeds a group (30) to be wrapped to said packaging station on a feed-conveyor plane, and wherein the wrapping of the group (30) takes place on said main track (52) in a plane lower than said feed conveyor plane; and further comprising a vertically movable lifting stage means (51) for lowering the group (30) from said feed-conveyor plane to said plane of said main track (52).

10. Apparatus according to claim 9, further comprising movable sidewalls (60), in a region of said lifting stage means (51), for compressing the group (30) of small packs (21) before wrapping thereof.

11. Apparatus according to claim 10, further comprising, at the same time the group (30) takes up a wrapping (31) laying itself around the group (30) in a U-shaped manner, means for conveying said group (30) into a folding station (68) until said group (30) abuts a bundle (20), located in front of said group, or against a bundle row.

12. Apparatus according to claim 1, wherein said folding means first folds rearwardly projecting longitudinal tabs (32, 33) of the wrapping (31) in a U-shaped manner so that upper longitudinal tab (32) is folded by said upper folder (71) until said upper tab (32) abuts a lower longitudinal tab (33) and is sealed thereto, and then folds a resulting edge strip (35) until said edge strip abuts said upper longitudinal tab (32).

13. Apparatus according to claim 12, wherein said lower folder (73), as a result of an upward movement thereof, folds said edge strip (35) until said edge strip (35) abuts said upper longitudinal tab (32).

14. Apparatus according to claim 13, wherein said front and rear side tabs (36, 37) of said wrapping (31) are foldable by said side folders (69) moving to and fro on both sides of the path of movement of the group (30), in such a way that, as a result of the advance of the group (30) together with the wrapping (31) against the bundle row (70), the side tab (36) located at the front in the direction of movement is folded, and the side folders (69) are conveyable away from the bundle (20) as a result of an oppositely directed movement.

15. Apparatus according to claim 14, wherein after the folding of the longitudinal tabs (32, 33), as a result of the movement of the side folders (69) in the direction of the group (30), said second folding means folds said rear side tabs (37) relative to said longitudinal tabs (32, 33).

16. Apparatus according to claim 14, further comprising fixed folding members for folding and sealing an upper tab (38) and a lower tab (39) of said wrapping.

17. Apparatus according to claim 1, wherein said upper folder (71) and said lower folder (73) are arranged on carrier members, in the form of a carrier section (76) and a sectional rod (79), extending transversely above said main track (52), ends of said carrier members being connected outside the path of movement of the bundles (20) to vertical guide rods (77, 80) which are movably mounted in a track plate (53) of each of said carrier devices and which are actuable on an underside of said track plate by means of fixed-location drives.

18. Apparatus according to claim 1, further comprising a common film appliance (66) assigned to said first and second packaging means for producing blanks by severing of said film web (65).

19. Apparatus according to claim 9, wherein said lifting stage means (51) comprises a platform on which said group (30) rests, and a platform cover which rests on the top side of said group (30).

20. Apparatus according to claim 19, further comprising guide means (96) for transporting groups (30) after they leave said lifting stage means (51).

* * * * *